US010822124B2

(12) United States Patent
Castellari et al.

(10) Patent No.: US 10,822,124 B2
(45) Date of Patent: Nov. 3, 2020

(54) UNIT AND METHOD FOR PLACING OBJECTS IN BOXES

(71) Applicant: GIMA S.p.A., Zola Predosa (IT)

(72) Inventors: Pierluigi Castellari, Castel San Pietro Terme (IT); Dario Rea, Monterenzio (IT); Massimiliano Medri, Imola (IT)

(73) Assignee: GIMA S.P.A., Zola Predosa (IT)

( * ) Notice: Subject to any disclaimer, the term of this patent is extended or adjusted under 35 U.S.C. 154(b) by 188 days.

(21) Appl. No.: 16/070,731

(22) PCT Filed: Feb. 3, 2017

(86) PCT No.: PCT/IB2017/050606
§ 371 (c)(1),
(2) Date: Jul. 17, 2018

(87) PCT Pub. No.: WO2017/137877
PCT Pub. Date: Aug. 17, 2017

(65) Prior Publication Data

US 2019/0016486 A1 Jan. 17, 2019

(30) Foreign Application Priority Data

Feb. 9, 2016 (IT) ..... 102016000013150

(51) Int. Cl.
*B65B 5/02* (2006.01)
*B65B 41/06* (2006.01)
(Continued)

(52) U.S. Cl.
CPC ..... *B65B 5/024* (2013.01); *B31B 50/024* (2017.08); *B31B 50/062* (2017.08); *B31B 50/07* (2017.08);
(Continued)

(58) Field of Classification Search
CPC ..... B65B 5/024; B65B 5/06; B65B 5/062; B65B 7/20; B65B 41/06; B65B 43/10;
(Continued)

(56) References Cited

U.S. PATENT DOCUMENTS 2,146,615 A * 2/1939 Bishop ..... C14B 1/26 198/687.1
2,171,131 A * 8/1939 Milmoe ..... B65B 43/185 53/57
(Continued)

FOREIGN PATENT DOCUMENTS

WO WO2015170295 A1 11/2015

OTHER PUBLICATIONS

International Search Report and Written Opinion dated Apr. 12, 2017 for counterpart PCT Application No. PCT/IB2017/050606.
(Continued)

*Primary Examiner* — Nathaniel C Chukwurah
*Assistant Examiner* — Lucas E. A. Palmer
(74) *Attorney, Agent, or Firm* — Shuttleworth & Ingersoll, PLC; Timothy Klima

(57) ABSTRACT

A unit for boxing packaged food products including a rotary element with at least one first seat for receiving a blank; a first transfer station for transferring the blank from a magazine for feeding blanks to a folding mould; a folding station for opening up, at least partly, the blank; a second transfer station for transferring the blank folded open from mould to the first receiving seat; an insertion station for inserting the packaged food products inside the blank folded open positioned on the first receiving seat; a closing station for closing the blank folded open, positioned on the second receiving seat and containing the packaged food products.

20 Claims, 10 Drawing Sheets

(51) Int. Cl.

| | |
|---|---|
| ***B65B 43/10*** | (2006.01) |
| ***B65B 43/14*** | (2006.01) |
| ***B65B 43/18*** | (2006.01) |
| ***B65B 43/26*** | (2006.01) |
| ***B65B 43/44*** | (2006.01) |
| ***B65B 43/46*** | (2006.01) |
| ***B65B 43/60*** | (2006.01) |
| ***B65B 5/06*** | (2006.01) |
| ***B65B 51/02*** | (2006.01) |
| ***B65B 7/20*** | (2006.01) |
| ***B31B 50/44*** | (2017.01) |
| ***B31B 50/07*** | (2017.01) |
| ***B65B 61/28*** | (2006.01) |
| ***B31B 50/06*** | (2017.01) |
| ***B31B 50/02*** | (2017.01) |
| ***B31B 50/62*** | (2017.01) |
| ***B31B 50/78*** | (2017.01) |
| ***B31B 50/80*** | (2017.01) |
| *B31B 100/00* | (2017.01) |
| *B65B 29/02* | (2006.01) |

(52) U.S. Cl.

CPC ..... *B31B 50/44* (2017.08); *B31B 50/622* (2017.08); *B31B 50/788* (2017.08); *B31B 50/80* (2017.08); *B65B 5/06* (2013.01); *B65B 5/062* (2013.01); *B65B 7/20* (2013.01); *B65B 41/06* (2013.01); *B65B 43/10* (2013.01); *B65B 43/145* (2013.01); *B65B 43/185* (2013.01); *B65B 43/265* (2013.01); *B65B 43/44* (2013.01); *B65B 43/46* (2013.01); *B65B 43/60* (2013.01); *B65B 51/02* (2013.01); *B65B 61/28* (2013.01); *B31B 2100/0026* (2017.08); *B31B 2100/0028* (2017.08); *B65B 29/02* (2013.01); *B65B 2220/02* (2013.01); *B65B 2220/16* (2013.01)

(58) Field of Classification Search

CPC ... B65B 43/145; B65B 43/185; B65B 43/265; B65B 43/44; B65B 43/46; B65B 43/60; B65B 51/02; B65B 61/28; B65B 29/02; B65B 2220/02; B65B 2220/16; B31B 50/07; B31B 50/788; B31B 50/622; B31B 50/44; B31B 50/062; B31B 50/024; B31B 50/80; B31B 2100/0026; B31B 2100/0028

See application file for complete search history.

(56) References Cited

U.S. PATENT DOCUMENTS 2,424,406 A * 7/1947 Marshall ..... B65B 11/32 53/449
2,443,952 A * 6/1948 Gilbert ..... B65B 11/42 53/234
2,603,047 A 7/1952 Malhiot
2,608,039 A * 8/1952 Abramowski ..... B65B 19/223 53/234
2,765,715 A * 10/1956 Kerr ..... 493/318
3,253,387 A * 5/1966 Schmermund ..... B65B 11/46 53/234
3,260,174 A * 7/1966 Pierce, Jr. ..... B31B 50/00 493/167
3,318,205 A * 5/1967 Lefief ..... B31B 50/00 493/8
3,385,176 A * 5/1968 Whitaker ..... B65B 19/24 493/207
3,521,530 A * 7/1970 Pierce, Jr. ..... B31B 50/00 493/137
3,583,295 A * 6/1971 Elder ..... B31B 50/00 493/18
3,626,819 A * 12/1971 Hoyrup ..... B31B 50/00 493/132
3,659,505 A * 5/1972 Wasyluka ..... B31B 50/00 493/102
3,813,849 A * 6/1974 Stambera ..... B65B 11/32 53/234
3,941,037 A * 3/1976 Reichert ..... B65B 5/024 493/167
4,085,568 A * 4/1978 Focke ..... B29C 65/48 53/234
4,092,816 A * 6/1978 Seragnoli ..... B65B 19/226 53/234
4,183,191 A * 1/1980 Focke ..... B65B 11/30 53/222
4,289,491 A * 9/1981 Collura ..... B31B 50/00 229/146
4,509,310 A * 4/1985 Focke ..... B65B 11/58 53/170
4,617,780 A * 10/1986 Focke ..... B65B 11/004 53/202
4,646,508 A * 3/1987 Focke ..... B65B 11/004 53/234
4,711,065 A * 12/1987 Focke ..... B65B 11/32 53/170
4,887,408 A * 12/1989 Mattei ..... B29C 65/18 53/412
5,085,028 A * 2/1992 Boriani ..... B29C 65/18 53/234
5,215,515 A * 6/1993 Bershadsky ..... B31B 50/00 493/315
5,533,323 A * 7/1996 Osti ..... B29C 65/02 53/225
5,694,738 A * 12/1997 Shigeta ..... B65B 11/30 53/228
5,718,103 A * 2/1998 Spada ..... B65B 11/32 53/148
5,732,533 A * 3/1998 Focke ..... B65B 51/023 53/234
5,791,124 A * 8/1998 Spatafora ..... B65B 5/026 53/444
5,876,319 A * 3/1999 Holton ..... B31D 1/005 493/120
5,906,087 A * 5/1999 Boldrini ..... B65B 51/023 53/234
6,000,199 A * 12/1999 Boldrini ..... B65B 11/30 53/234
6,047,529 A * 4/2000 Draghetti ..... B65B 11/30 53/234
6,085,494 A * 7/2000 Lembke ..... B65B 11/004 53/228
6,575,886 B1 * 6/2003 Tanck ..... B65B 43/185 493/164
7,146,777 B2 * 12/2006 Focke ..... B65B 19/223 53/52
2005/0005580 A1 * 1/2005 Spatafora ..... B65B 11/30 53/466
2011/0065559 A1 * 3/2011 Atoui ..... B31B 50/00 493/175
2012/0291398 A1 * 11/2012 Draghetti ..... B65B 19/223 53/170
2015/0031517 A1 * 1/2015 Cavazza ..... B65B 43/185 493/124
2015/0031519 A1 * 1/2015 Cavazza ..... B65B 43/265 493/441

OTHER PUBLICATIONS

Italian Search Report dated Oct. 20, 2016 for counterpart Italian Patent Application No. UB20160604.

* cited by examiner

UNIT AND METHOD FOR PLACING OBJECTS IN BOXES

This application is the National Phase of International Application PCT/IB2017/050606 filed Feb. 3, 2017 which designated the U.S.

This application claims priority to Italian Patent Application No. 102016000013150 filed Feb. 9, 2016, which application is incorporated by reference herein.

TECHNICAL FIELD

This invention relates to a unit and a method for boxing objects (that is, placing objects in boxes), in particular packaged food products, such as single-use capsules (containing infusion and/or extraction products such as, for example, coffee, tea, etc., or soluble products, or food products in general, such as marmalade, creams) or single-use packages of processed cheese, etc.).

BACKGROUND ART

It should be noted that the expression "packaged food products" is to be considered to mean hereafter food products positioned inside suitable packages (so-called primary packaging), of various types and type.

For example, in the case of products such as packaged cheese, the package consists of a piece of sheet (compatible with food products) wrapping and enclosing the food product.

On the other hand, for products such as packaged coffee, the package consists of a wrapper enclosing the coffee powder (so-called capsule). Prior art single-use capsules containing infusion and/or extraction products, used in machines for making beverages, comprise, by way of non-limiting example, and in their simplest form, the following:

- a rigid, cup-shaped outer container comprising a perforatable or perforated bottom and an upper aperture provided with a rim (and usually, but not necessarily, having the shape of a truncated cone);
- a dose of product for extraction or infusion beverages contained in the outer container; and
- a length of sheet obtained from a web for sealing (hermetically) the aperture of the rigid container and designed (usually but not necessarily) to be perforated by a nozzle which supplies liquid under pressure.

Usually, but not necessarily, the sealing sheet is obtained from a web of flexible material.

In some cases, the capsules may comprise one or more rigid or flexible filtering elements.

For example, a first filter (if present) may be located on the bottom of the rigid container.

A second filter (if present) may be interposed between the piece of sealing sheet and the product dose.

The dose of product may be in direct contact with the rigid, cup-shaped outer container, or with a filtering element.

The capsule made up in this way is received and used in specific slots in machines for making beverages.

In the sector in question, that is to say, the production of capsules, so-called "boxing machines" are known of the horizontal type.

A boxing machine of the horizontal type typically comprises a belt for conveying cartons on a horizontal plane, already opened up and pre-glued, and a device for loading capsules positioned alongside the conveyor belt. Pusher devices pushers suitably synchronised and coordinated with the belt for conveying cartons push the capsules into the cartons along a direction parallel to the longitudinal direction of the carton. These boxing machines of the horizontal type are usually very long and bulky.

There are also prior art vertical machines, comprising a movement device which moves the boxes already opened up and pre-glued positioned vertically, and a device for insertion in the vertical direction. These vertical type machines are not generally used for inserting the capsules inside the boxes, since it is difficult to control the stacks of capsules, or objects in general, arranged vertically.

A strongly felt current need is that of providing a boxing machine which is able to carry out the simultaneous insertion of a plurality of objects, for example packaged food products, in a particularly quick and easy manner and which is also able to operate with boxes made and formed starting from flat blanks, which are more economical relative to pre-glued blanks.

DISCLOSURE OF THE INVENTION

The aim of this invention is therefore to provide a boxing unit and method for which are capable of inserting products of the single-dose capsule type inside boxes in a particularly simple and easy manner.

Yet another aim of this invention is therefore to provide a boxing unit and method for which are capable of inserting objects, preferably packaged food products (yet more preferably of the single-dose capsule type) inside boxes made starting from flat blanks.

Yet another aim of this invention is therefore to provide a boxing unit which can form a valid and effective alternative to the prior art machines.

A further aim of this invention is to provide a boxing unit or reduced size.

BRIEF DESCRIPTION OF THE DRAWINGS

The technical features of the invention, with reference to the above aims, are clearly described in the claims below and its advantages are apparent from the detailed description which follows, with reference to the accompanying drawings which illustrate a non-limiting example embodiment of the invention and in which:

DETAILED DESCRIPTION OF PREFERRED EMBODIMENTS OF THE INVENTION

With reference to the accompanying drawings, the numeral 1 denotes a unit for boxing objects, preferably a plurality of packed food products and even more preferably single-use capsules (containing preferably infusion or extraction products such as, for example, coffee, tea, herbal tea, etc., or soluble food products, or food products such as creams, marmalade, etc.), that is, a unit for inserting one or more objects in a box formed starting from a flat blank SB (advantageously made from paper material).

This description will hereinafter refer to single-use capsules, but it is understood that the invention is not limited to these capsules, but is advantageously applied for any other object designed to be packaged in boxes, such as, for example, packaged food products, for example packaged in a primary packaging, such as individual packages of processed cheese, confectionery products and foodstuffs in general, etc.

The unit 1 is designed to open up (that is, form) a blank SB, for forming a box, to insert products of the single-use capsules type inside the blank SB, and to close the blank SB.

The blank SB (FIG. 11) comprises a base or lower wall SB1, lateral walls (SB2, SB3, SB6, SB7, SB8, SB9, SB10, SB11, SB12, SB13), and at least one upper or closing wall (SB4, SB5).

The lateral walls (SB2, SB3, SB6, SB7, SB8, SB9, SB10, SB11, SB12, SB13), in combination with the base wall SB1, define a compartment for containing capsules.

Figure 1:
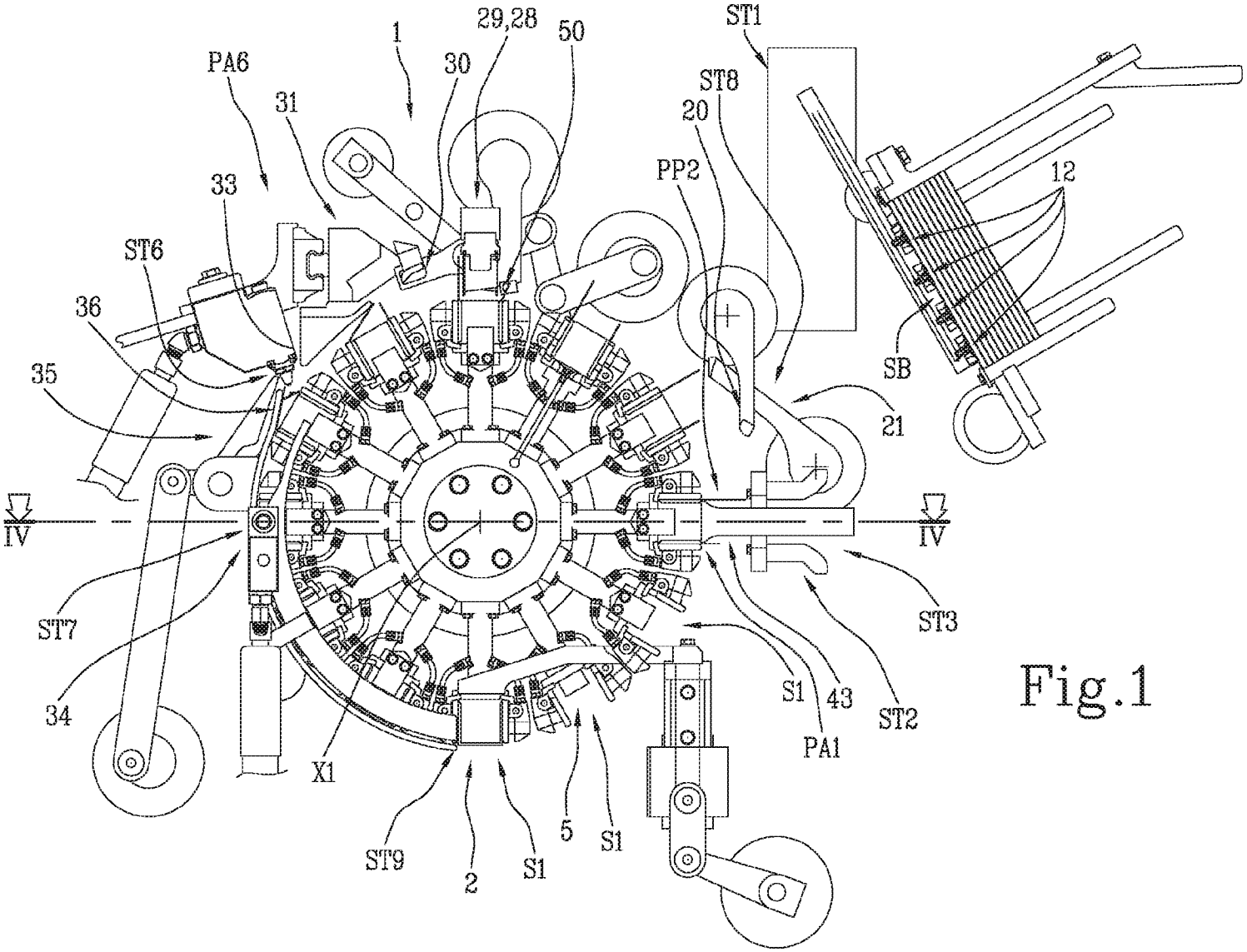
FIGS. 1 to 3 illustrate respective schematic front views, partly in cross section according to a vertical plane, of a unit for packaging single-use capsules according to the invention in different operating configurations according to a first embodiment.

According to the invention, the unit 1 for boxing single use capsules comprises a rotary element 2, rotating about a first axis X1 of rotation (FIG. 1).

The rotary element 2 comprises at least one first seat S1 for receiving a blank SB defining a box S and is designed to rotate the above-mentioned at least one first receiving seat S1 in a plurality of angular positions of rotation.

The rotary element 2 comprises a rotary supporting body (or shaft) 18.

The rotary element 2 is rotated preferably by means of an actuator; still more preferably by means of a drive unit.

More preferably, as illustrated, the rotary element 2 comprises a plurality of first receiving seats S1, arranged in different angular positions (offset) of the first rotary element 2, with each of the first receiving seats S1 designed to receive, in use, a blank SB.

According to another aspect, each first receiving seat S1 is defined by at least one cavity 5 (radial), positioned substantially aligned along a direction of extension of the first axis X1.

According to another aspect of the invention, the unit 1 also comprises a first transfer station ST1 for transferring a blank SB from a magazine 4 for feeding blanks SB to a folding mould 14 (the latter forming part of the unit). The feeding magazine 4 is designed to contain a plurality of blanks SB in the flat configuration, open and not pre-glued.

Figures 11, 12, 13:
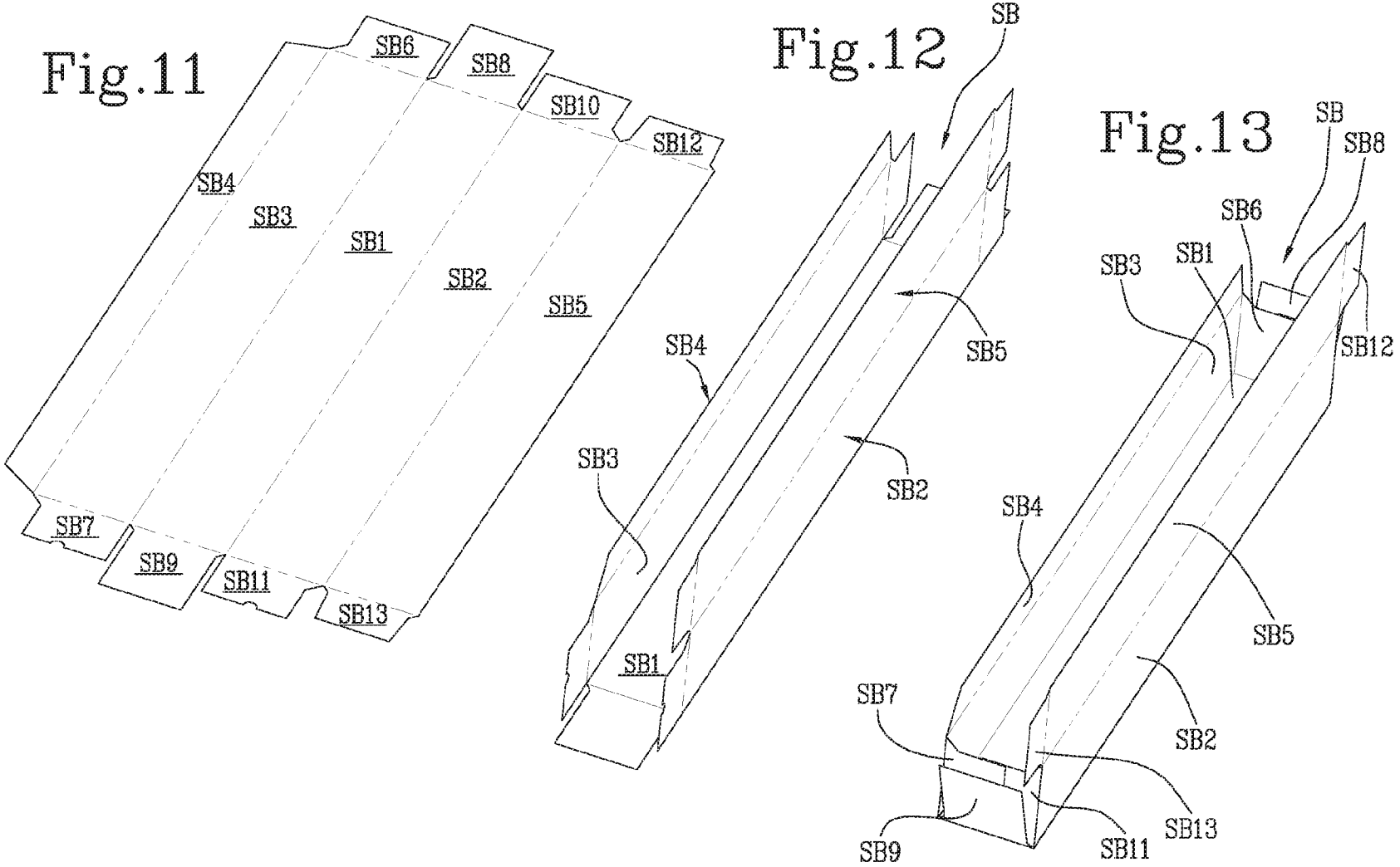
FIGS. 11 to 17 illustrate schematic views respectively of a blank SB, used in the unit according to the invention, in different operating steps.
Figures 14, 15, 16, 17:
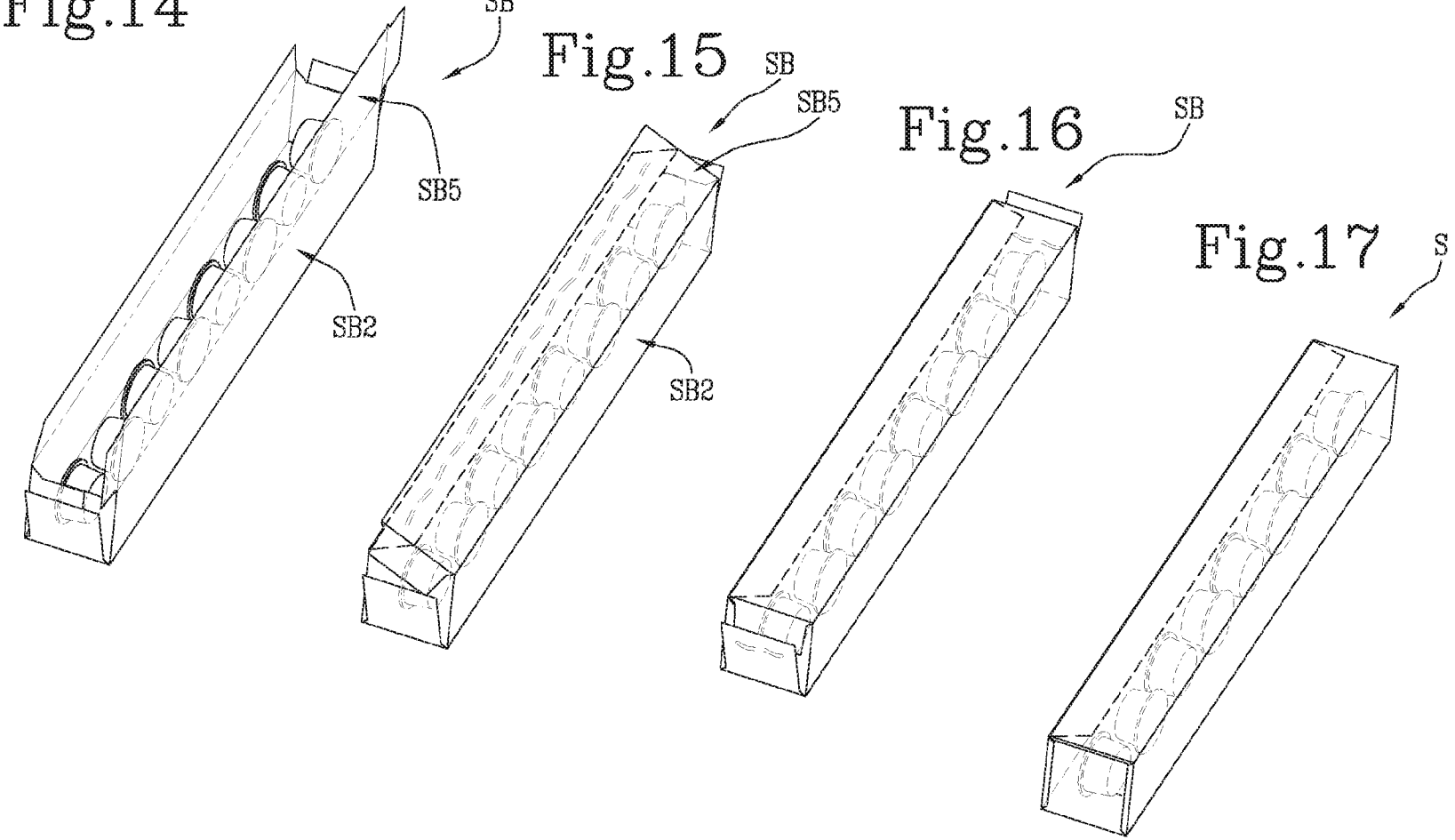

FIG. 11 shows a blank SB in the flat configuration, open and not pre-glued.

Reference is made below to the blank SB, without this limiting the scope of the invention.

The blank SB has a lower, or bottom, face SB1, a first lateral face SB2 and a second lateral face SB3.

Moreover, the blank SB has a first upper face SB4 and a second upper face SB5.

The blank SB also has a third lateral face (or first upper lateral) SB12 and a fourth lateral face (or second upper lateral) SB13, which are connected, respectively, at opposite ends of the second upper face SB5.

The blank SB comprises a fifth lateral face SB8 and a sixth lateral face SB9, which are connected, respectively, at opposite ends of the lower face SB1.

The blank SB comprises a seventh lateral face SB10 and an eighth lateral face SB11, which are connected, respectively, at opposite ends of the first lateral face SB2.

The blank SB comprises a ninth lateral face SB6 and a tenth lateral face SB7, which are connected, respectively, at opposite ends of the second lateral face SB3.

The blank SB has, in its flat configuration, two respective opposite surfaces (which are defined by the above-mentioned faces): a so-called "outer" surface, which in its final use (with box closed) at least partly faces towards the outside, that is, towards the user, and an "inner" surface, which in the final use faces towards the inside.

It should be noted that, inside the feeding magazine 4, the blanks SB are arranged in the flat configuration substantially aligned in contact with each other.

It should be noted that, preferably, the so-called "outer" surfaces are positioned facing towards the rotary element 2, that is, towards the first seats S1 when they are positioned at the transfer station ST1.

According to the invention, the unit 1 comprises a folding station ST2, designed to open up, at least partly, the blank SB positioned on the folding mould 14.

Again according to the invention, the folding station ST2 comprises a punch 43, acting in conjunction with the folding mould 14 for opening up the blank SB, the punch 43 being movable at least between a first end position PP1 for contact with the blank SB positioned on the folding mould 14 and a second end position PP2 for opening up and transferring the blank SB on the first receiving seat S1.

It should be noted, with reference to the accompanying drawings, that preferably the rotary member 2 rotates in an anticlockwise direction.

According to the invention, the unit 1 comprises a second transfer station ST3 designed to transfer the blank SB opened up by the folding station ST2 to the first receiving seat S1 active in a (first) predetermined angular position PA1 of rotation of the first receiving seat S1.

According to yet another aspect of the invention, the unit 1 comprises an insertion station ST4 for inserting the packaged food products inside the blank SB folded open and positioned on the first receiving seat S1, acting in a second predetermined angular position PA2 of rotation of the first receiving seat S1.

The ST4 station comprises, preferably, a device 28 for inserting capsules inside the blank SB opened up and contained in the first seat S1.

It should be noted that the device 28 for inserting capsules comprises an movable element 29 (shown in FIGS. 1 and 2), configured for retaining the capsules and moving the capsules from a position for picking up the capsules to a position for releasing the capsules inside the first seat S1.

Preferably, the movable element 29 is equipped with a gripper or one or more suction cups, configured to retain (and move) the capsules.

With reference to another aspect of the invention, the unit 1 also comprises a station ST5 for closing the blank SB folded open positioned on the second receiving seat S1 and containing the capsules.

Preferably, the closing station ST5 comprises a fixed contact element 31 (upper faces of the blank SB) and a movable contact element 30 (upper faces of the blank SB).

The closing station ST5 acts in a predetermined (third) angular position PA6 of rotation of the first receiving seat S1 (after the second position PA2, that is, after the station ST4 for inserting products).

According to another aspect of the invention, the unit 1 also comprises a first station ST6 for gluing first portions of the blank SB folded open positioned on the first receiving seat S1 and containing the capsules, acting in a predetermined (fourth) angular position of rotation of the first receiving seat S1 (preferably, the predetermined angular position of rotation is subsequent to, or partly coinciding with, that in which the blank is closed, that is to say, when the operating station ST5 is active).

It should be noted that, preferably, the first gluing station ST6 provides for the gluing together of the first and second upper face SB4 and SB5.

Preferably, therefore, the first gluing station ST6 comprises a first device 33 for distributing (that is, releasing) glue.

Preferably, the first device for distributing (releasing) glue is movable (preferably along a direction of extension of the first axis X1).

Preferably, the unit 1 comprises a second station ST7 for gluing second portions of the blank SB folded open positioned on the first receiving seat S1 and containing the capsules.

Preferably, the second gluing station ST7 is positioned downstream of the first gluing station ST6.

Preferably, the second gluing station ST7 acts in a predetermined (fifth) angular position of rotation of the first receiving seat S1 after an angular position of the first seat S1 in which the first gluing station ST6 is active. Alternatively, the second gluing station ST7 may be integrated, and positioned together, with the first gluing station ST6.

It should be noted that the second gluing station ST7 preferably comprises a second device 34 for distributing (releasing) glue.

The second device 34 for releasing glue is designed to distribute (release) glue at the third and fourth lateral faces, labelled SB12 and SB13.

According to another aspect, the station ST1 for transferring a blank SB from a magazine 4 for feeding blanks SB to the mould 14 comprises a transfer arm 10.

Figure 5:
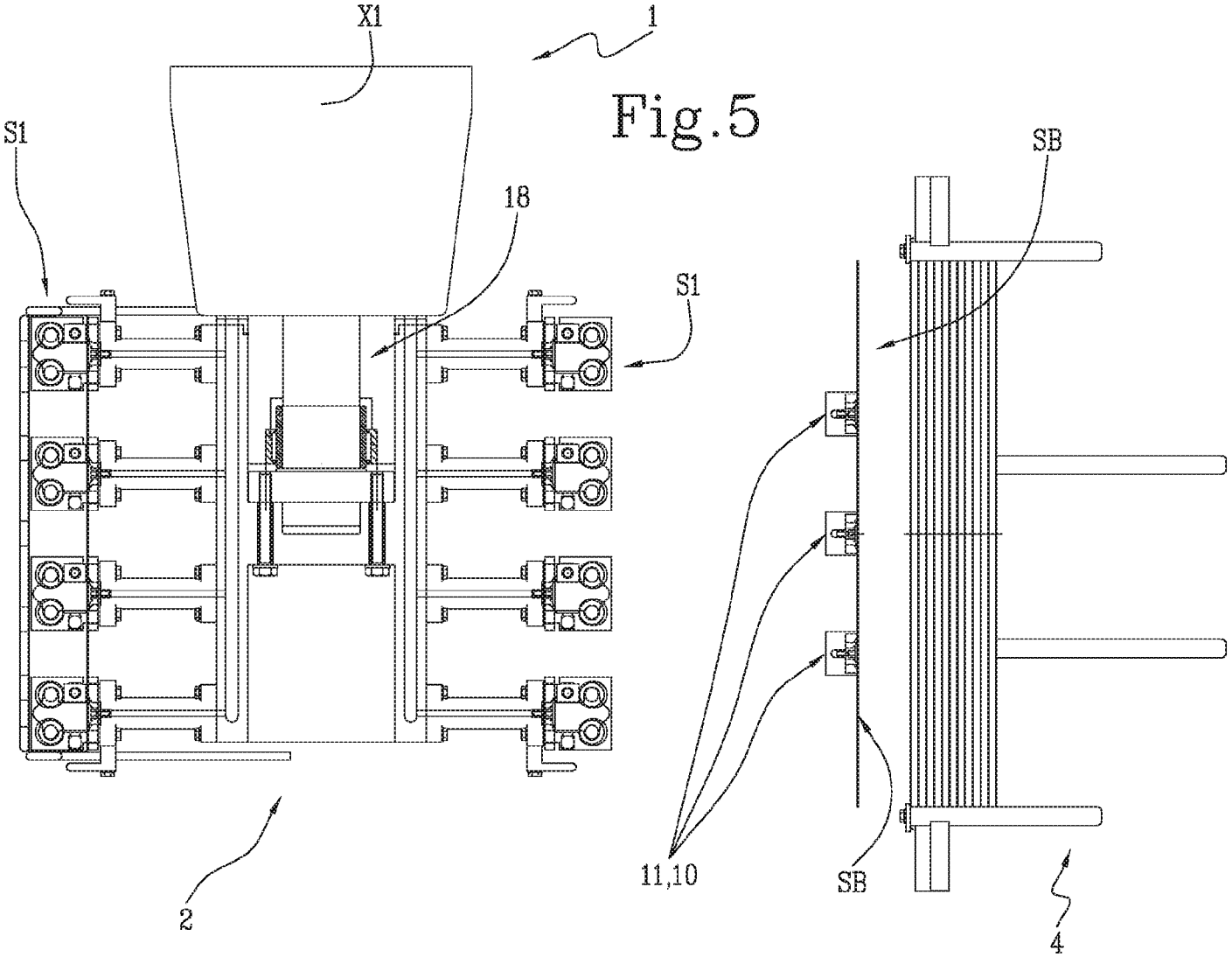
FIG. 5 illustrates a respective schematic cross section view along the line V-V of the unit for boxing single-use capsules of FIG. 2, with some parts cut away to better illustrate others.
Figure 6:
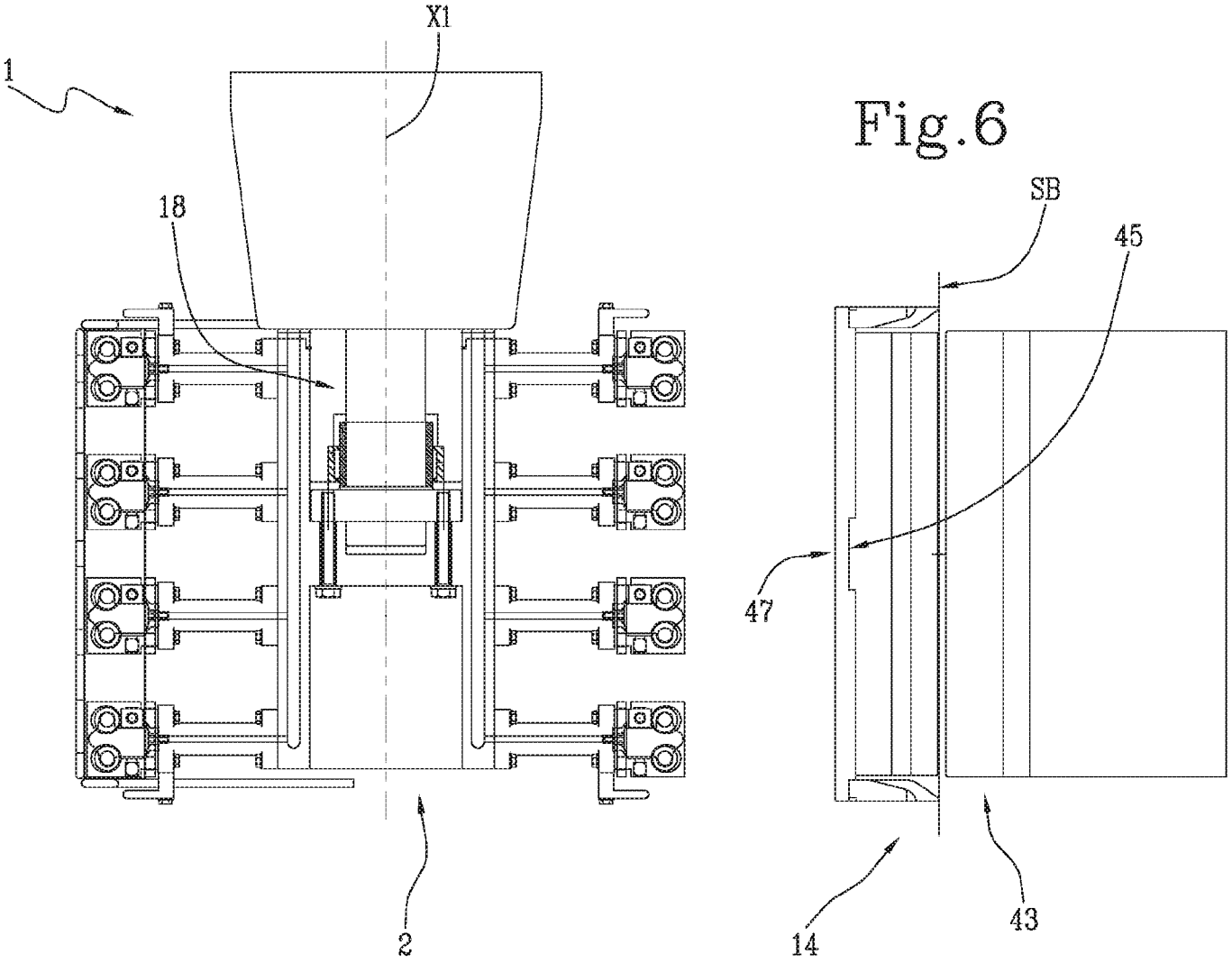
FIG. 6 illustrates a respective schematic cross section view along the line VI-VI of the unit for boxing single-use capsules of FIG. 3, with some parts cut away to better illustrate others.
Figure 7:
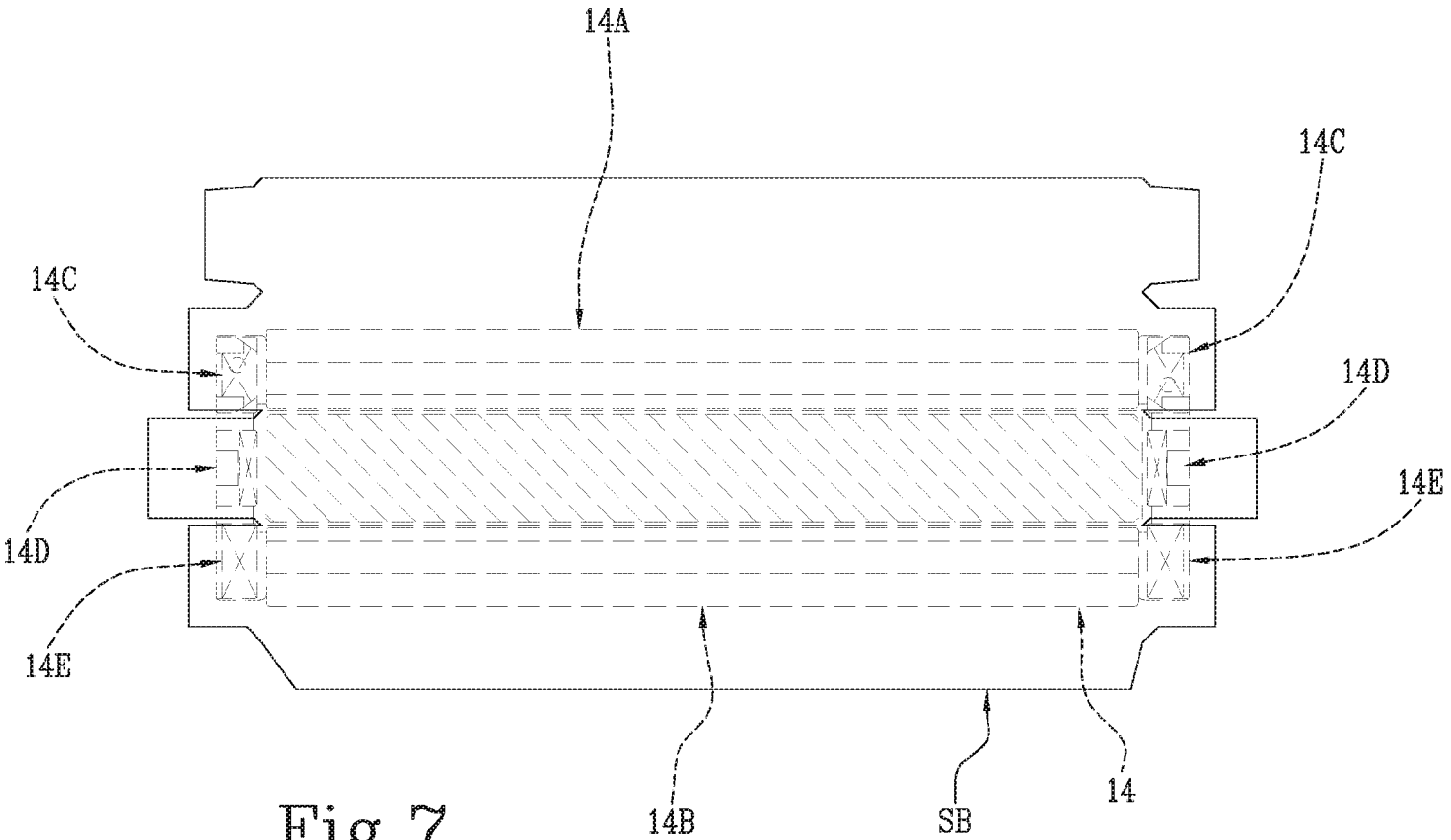
FIG. 7 illustrates a schematic view respectively of a detail of the boxing unit according to the previous drawings.
Figure 8:
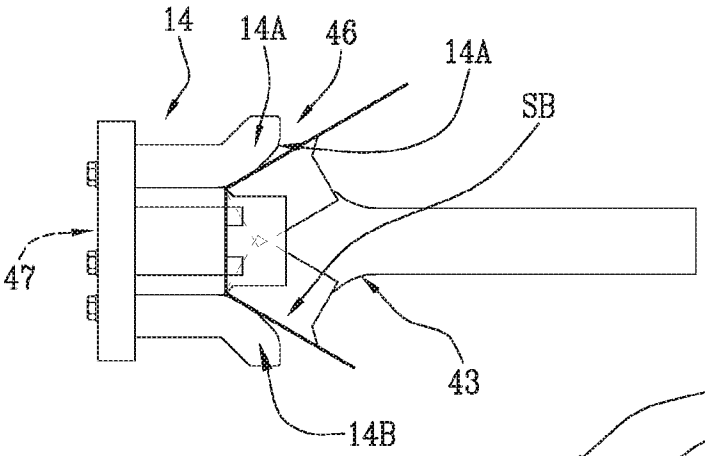
FIGS. 8 to 10 illustrate schematic views of a detail of the boxing unit of FIGS. 1 to 3 in different operating configurations.
Figure 9:
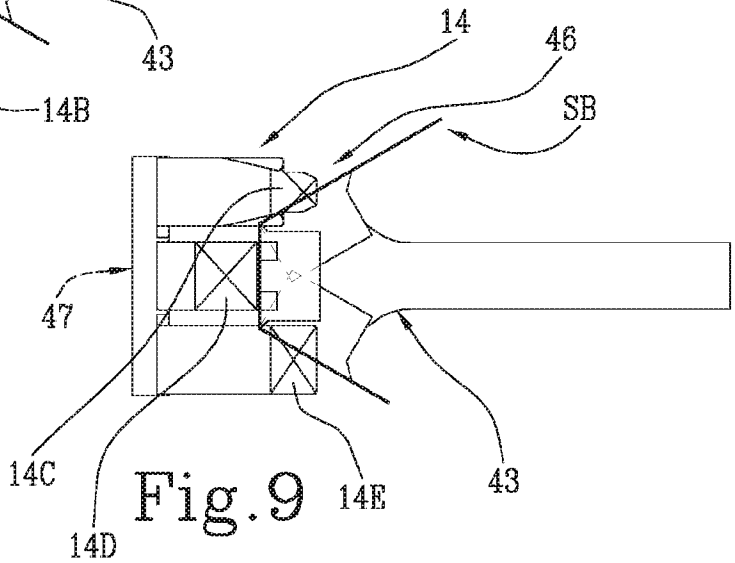
Figure 10:
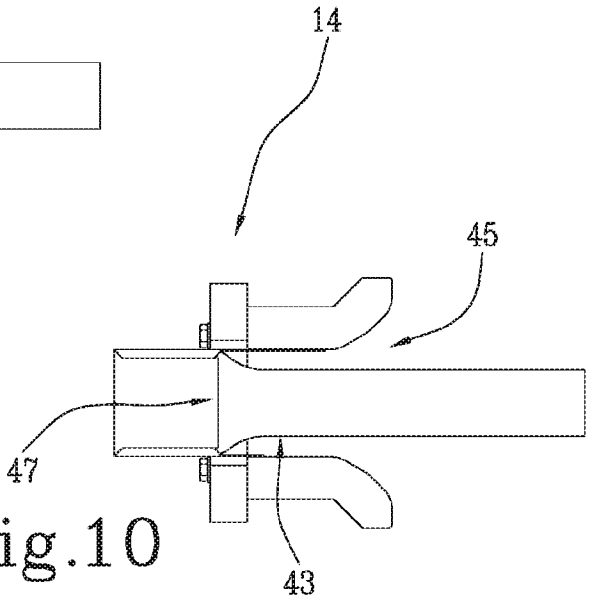

The transfer arm 10 preferably comprises a plurality of prongs 11 (FIG. 5).

Figure 3:
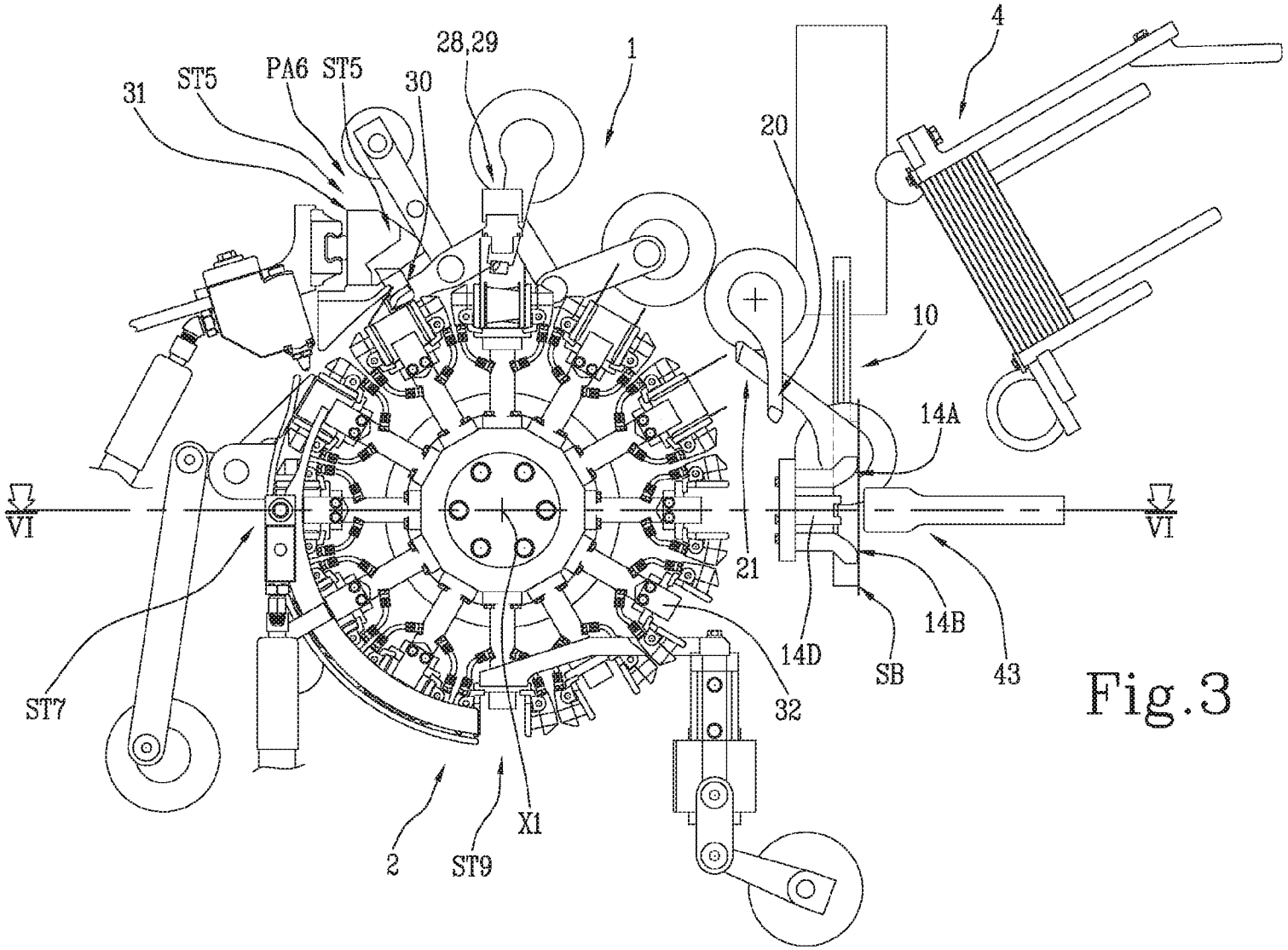
Figure 4:
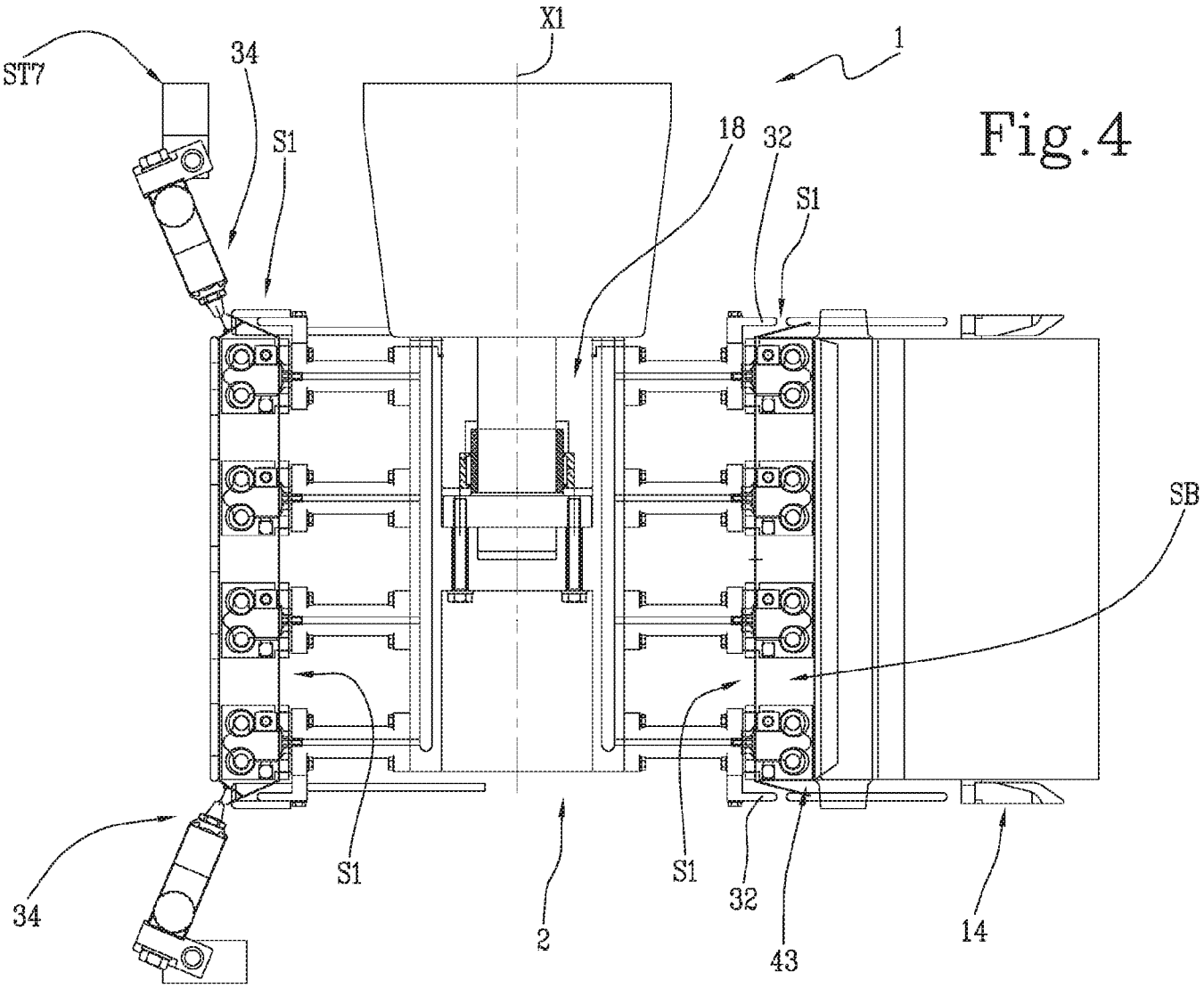
FIG. 4 illustrates a respective schematic cross section view along the line IV-IV of the unit for boxing single-use capsules of FIG. 1, with some parts cut away to better illustrate others.

The transfer arm 10 is movable between a position for picking up the blank SB from the feeding magazine 4 (illustrated in FIG. 1) and a position for releasing the blank SB on the mould 14 (illustrated in FIG. 3).

According to another aspect, the prongs 11 comprise a plurality of suction cups 12, positioned facing towards the feeding magazine 4 for picking up the blank SB.

Preferably, each of the prongs 11 carries a plurality of suction cups 12.

According to another aspect, the folding station ST2 comprises a mould 14.

The mould 14 is preferably positioned in a predetermined position relative to the rotary unit 2.

Preferably, but not necessarily, the mould 14 is a stationary mould, that is to say, positioned in a predetermined position relative to the frame of the unit 1.

It should be noted that the mould 14 is configured to operate substantially in conjunction with the punch 43, forming part of the unit 1 and in particular the folding station ST2, and already described above.

The mould 14 comprises a through opening 44.

The punch 43, as described above, is movable at least between a first end position PP1 of contact with the blank SB positioned on the mould 14, and a second end position PP2 for opening up the blank SB (in a respective seat 46 of the mould 14) and transferring the blank SB on the first seat S1.

The punch 43 further defines the second transfer station ST3 designed to transfer the blank SB opened up by the folding station ST2, in particular by the mould 14, to the first receiving seat S1 active in a first predetermined angular position PA1 of rotation of the first receiving seat (S1).

It should be noted that, preferably, the punch 43 and opening 44 are designed in such a way that the punch 43 can at least partly pass through the opening 44.

Preferably, the opening 44 is sized to allow to a passage by a bottom wall SB1 of the blank SB opened up (pushed by the punch 43).

The mould 14 is illustrated in FIGS. 7 to 10.

It should be noted that, preferably, the mould 14 comprises a first element 14A, designed to make contact with the first lateral face SB2 to make a fold (at 90°) and a second element 14B designed to make contact with the second lateral face SB3 to make a fold (at 90°).

Also, preferably, the mould 14 comprises further contact elements (for example, the elements illustrated in FIG. 7 and labelled 14C, 14D, 14E), preferably positioned in two different positions along a direction parallel with the first axis X1 of rotation (on opposite sides of the blank SB), to the folding of the lateral faces SB10, SB11, SB8, SB9, SB6 and SB7, respectively.

More specifically, a first group of further contact elements of the mould 14 is active at the faces SB10, SB8 and SB6 of the blank SB, to carry out substantially a folding at 90° whilst a second group of further contact elements is active at the faces SB11, SB7 and SB9 of the blank SB, to carry out substantially a folding at 90°.

It should be noted in particular that, at the folding station ST2, the blank is folded substantially to be configured as illustrated in FIG. 13: in particular, the faces SB2 and SB3 are positioned substantially at 90° relative to the face SB1 whilst the faces SB10 and SB6 are folded substantially at 90° so as to be positioned inside the face SB8 and the faces SB11 and SB7 are folded at 90° so as to be positioned inside the face SB9 (see FIG. 13).

With regard to the faces SB8 and SB9, they are folded by an angle of less than 90° and are fastened to the retaining element 32.

According to another aspect, the unit 1 comprises a deformation (that is to say, weakening) station ST8.

The deformation station ST8 is active on the first upper face SB4 so as to weaken a connecting hinge between the first upper face SB4 and the second lateral face SB3.

More specifically, advantageously, the deformation station ST8 guarantees that the blank SB does not tend to re-open due to the elastic return of the first and second upper faces SB4, SB5.

It should be noted that, according to another aspect, in order to be certain that the preformed the blank SB is perfectly open at the filling station ST4, the unit 1 may also comprise a further station for partial reopening, coupled and/or integrated to the filling station ST4, designed to partly reopen the first and/or second upper faces SB4/SB5, operating on the blank SB before the filling station ST4 (when the blank SB is coupled to the first receiving seat S1).

In the embodiment illustrated in the drawings, the partial opening station is defined by a pin 50 designed to make contact with the first upper face SB4 and to keep the first upper face SB4 open, whilst the filling station ST4 inserts the capsules inside the blank SB opened up. The pin 50 may advantageously be movable so as to guarantee making contact with the first upper face SB4, in any position the latter adopts downstream of the deformation station ST8. A similar further pin may be provided, movable, to make contact with the second upper face SB5.

The above-mentioned angular position of rotation of the first receiving seat S1 in which the deformation station ST8 is active is preferably after (or coincident with, in a variant embodiment not illustrated) the angular position of rotation in which the first seat S1 receives the blank SB.

Preferably, as illustrated, the deformation station ST8 comprises at least a first and a second contact element (20, 21), movable between a non-operating position away from the first seat S1 (FIG. 1) and an operating position close to the first seat S1 wherein the contact elements (20, 21) make contact with the first upper face SB4 of the blank SB for weakening the connecting hinge with the second lateral surface SB3.

According to yet another aspect, the unit 1 also comprises a station ST9 for releasing the box S, formed starting from the blank SB and containing the products, acting in a predetermined angular position of the first seat S1 (after the position of the first gluing station ST6 and preferably after the second gluing station ST7).

The release station ST9 comprises an arm 40 for picking up the box S containing the products, designed to transfer the box S in a subsequent line, or magazine, that is to say, container (not illustrated).

It should be noted that, preferably, the first rotary element 2 is driven step by step.

The invention will now be described in more detail, with reference to the insertion of a group of capsules in a box formed starting from a blank SB.

The arm 10, at the transfer station ST1, picks up a blank SB from the feeding magazine 4: it should be noted that the suction cups 12 of the prongs 11 are operating on the so-called "outer" surface of the blank SB, that is to say, on surface which is visible when the box S is completed.

The arm 10, after having picked up a blank SB, is moved towards the first mould 14.

It should be noted that an actuator (schematically illustrated in the accompanying drawings) allow the movement of the arm 10 according to one or more degrees of freedom (with linear and/or rotational movements).

Preferably, the arm 10 is moved at least vertically, from the top downwards, from the position for picking up the blank SB to the position of delivering the blank SB to the mould 14.

It should be noted that the blank SB is positioned by the arm 10 substantially with the outer face facing towards an inlet opening 45 of the cavity of the mould 14.

The arm 10 supports the blank SB at of the mould 14.

It should be noted that, during this step, the punch 43 makes contact with the "inner" surface of the blank SB and inserts the blank SB inside the seat 46 of the mould 14 (through the inlet opening 45).

It should be noted that the punch 43 makes contact with the zone of the blank SB corresponding substantially to the bottom face SB1 of the blank, in such a way as to push the blank into the seat 46 of the mould 14. The punch 43 may advantageously be provided with gripping suction cups, to retain the blank at the bottom face SB1.

As a result of insertion of the blank SB inside the seat of the mould 14, the first and the second lateral faces SB2 and SB3 are substantially folded at 90°.

More precisely, the elements 14A and 14B of the mould 14 make contact with, fold and move the first and the second lateral faces SB2/SB3.

It should also be noted that the further contact elements 14C, 14D and 14E fold the faces SB6, SB7, SB8, SB9, SB10 and SB11, respectively.

The blank SB is, at the end of the movement of the punch 43, configured as shown in FIG. 13.

It should be noted that, in the folding station ST2, the seventh lateral face SB10 and the ninth lateral face SB6 are positioned inside the fifth lateral face SB8, and the eighth lateral face SB11 and the tenth lateral face SB7 are positioned inside the sixth lateral face SB9.

After completing the above-mentioned step of folding the blank, the punch 43 pushes further the bottom wall SB1 to move it forward through the outlet opening 47, so as to transfer the blank SB from the seat 46 of the mould 14 to the first seat S1.

Advantageously, the first seats S1 may be equipped with suction cups designed to retain the blank SB.

It should be noted that the suction cups the of the first seat S1 are substantially activated during or after transfer of the first blank SB, so as to allow the retaining of the blank SB inside the first seat S1.

A step forward is then made (that is to say, the rotary element 2 is rotated to move the first seat S1 to a different angular position) and the blank SB is moved to the next station ST8 for deformation (or weakening) of the first upper face SB4 (that is, the face with smaller surface extension, that is, the greater elastic return, relative to the second upper face SB5).

Figure 2:
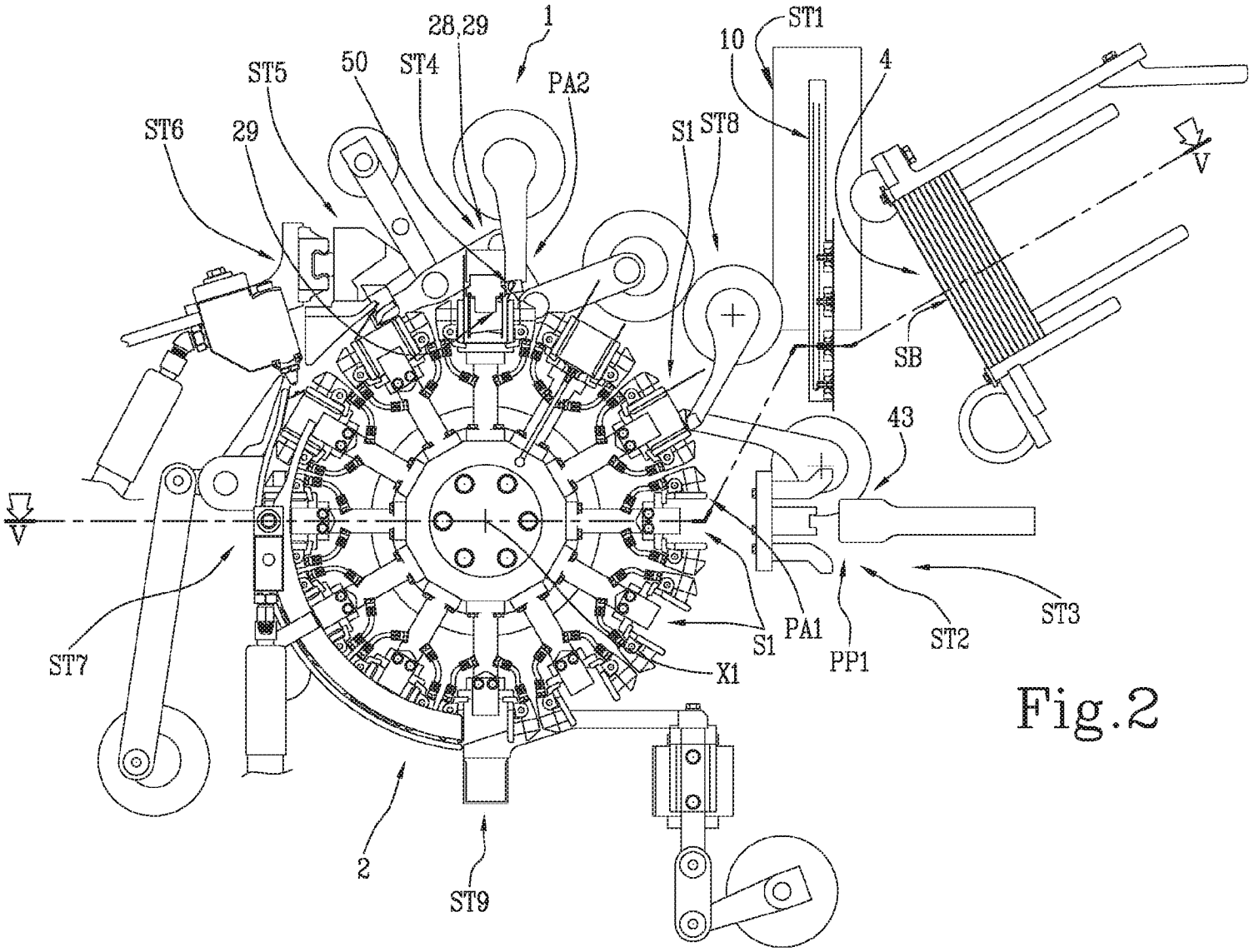

It should be noted that the fifth, seventh and ninth lateral faces SB10, SB8, SB6 (and, equally, the sixth, eighth and tenth lateral faces SB11, SB9 and SB7) are preferably retained in the folding position during the transfer to the first seat S1. It should be noted that, at the deformation station ST8, the contact elements (20, 21) are moved from the non-operating position away from the first receiving seat S1 to the operating position close to the first receiving seat S1, wherein the contact elements (20, 21) make contact with the first upper face SB4 (as shown in FIG. 2).

It should be noted that the rotary element 2 is then rotated further in an anticlockwise direction, until the blank SB is moved to the station ST4 for inserting capsules.

At the station ST4 for inserting capsules an arm inserts the capsules (or, more generally, the items) inside the space for containment of capsules defined by the blank SB.

Advantageously, the insertion station ST4, in particular the arm, is designed to insert the capsules inside the blank SB according to a direction of insertion which is perpendicular to a longitudinal direction of the box S.

This makes it possible to obtain extremely short strokes of the arm, and therefore reduced insertion times.

Preferably, in the insertion station ST4 reopens the box S, that is to say, it make contact with the first and/or the second upper face SB4 and SB5 of the blank, arranging it in the correct opening position, to ensure that the blank is in the correct configuration for receiving the packaged products and therefore avoid problems during insertion.

Advantageously, the arm of the insertion station ST4 is movable along a direction of insertion radial relative to the rotary element 2.

It should therefore be noted that the blank SB is filled with a predetermined number of capsules.

The rotary element 2 is then rotated further and the blank SB is positioned at the closing station ST5.

The first and second upper faces SB5 and SB4 are folded at the closing station ST5.

More specifically, it should be noted that the second upper face SB5 is folded by means of the element 31 of fixed type, whilst the first upper face SB4 is folded by means of the movable contact element 30.

It should be noted that the movable contact element 30 is movable between a non-operating position of non-interference with the first upper face SB4 and an operating position of interference with the first upper face SB4.

In a successive angular position (or according to a different variant, in the same angular position in which the closing station ST5 is operating), the gluing of the first and second upper face SB5 and SB4 to each other is substantially performed.

More specifically, as illustrated in FIG. 2, the first gluing device 33 distributes a layer of glue on the first upper face SB4, even more specifically on an outer surface of the first upper face SB4.

The first device 33 is preferably movable along the direction of the first axis X1 of rotation, for distributing a layer of glue in a plurality of predetermined points (continuous or discontinuous) of the outer surface of the first upper face SB4.

It should be noted that the third and fourth lateral faces SB12 and SB13 are inserted inside, respectively, the fifth and sixth SB8 SB9 lateral faces.

It should be noted that the unit 1 also comprises a movable device 35 for contact of the first SB5 and the second SB4 upper face, operating downstream of the first gluing station ST6.

The device 35 is movable between a position of non-interference with the first SB4 and the second SB5 upper face and an operating position, in which it comes into contact with the second face SB5 to push it into contact with the first upper face SB4, in the final closing position.

Preferably, the unit 1 may also comprise an element 36, that is, a contact guide, suitably shaped, configured to keep the second upper face SB5 in contact with the first upper face SB4 in the final closing position, positioned and operational downstream of the movable contact device 35.

Preferably, the element 36, that is, the contact guide, operates on the second upper face SB5 during the rotation of the rotary element 2 towards the release station.

In the next step the blank SB is moved to the second gluing station ST7.

At the second gluing station ST7, the second glue releasing device 34 glues the fourth lateral face SB13 on the sixth lateral face SB9 and the third lateral face SB12 on the fifth lateral face SB8.

It should be noted that the unit 1 also comprises a pair of contact elements, acting on the fifth and on the sixth lateral face SB8 and SB9 after gluing by the second gluing device 34, to keep the fifth and the sixth lateral face SB8 and SB9 pressed, respectively, against the third lateral face SB12 and the fourth lateral face SB13 (in order to allow the adhesion by the glue).

It should be noted that the blank SB opened up, containing the capsules and closed using gluing (thus defining a package or box S) is moved to the release station ST9.

The picking up arm 40, in the release station ST9, grips the box S and detaches it from the first seat S1 (upon this gripping operation, the suction cups operating on the first seat S1 are deactivated).

With reference to FIGS. 11 to 17, it should be noted that these drawings illustrate the steps of folding, closing and gluing performed in the different stations of the unit 1.

It should be noted that this invention also defines a machine for making boxes containing objects, such as, for example, single-use capsules containing infusion or extraction product, comprising a plurality of stations configured for operating in a synchronised fashion, comprising at least:

a station for feeding packages into corresponding seats of a transport element;

a station for filling packages with a predetermined quantity of product;

a station for closing the packages, for closing the objects to be boxed;

an outfeed station which picks up the objects from the respective seats of the transport element; and the boxing unit 1 described previously.

In addition to the stations listed above, the machine for making boxes may comprise further stations, such as, for example, one or more weighing stations, one or more cleaning stations, one or more control stations and, depending on the type of objects to be packaged, one or more further operating stations. For example, in the case for boxing single-use capsules for extraction products, the machine may comprise one or more stations for applying filtering elements to a rigid container of the capsules.

An advantage of this invention is to have provided a boxing unit 1 which is particularly simple to use and which can constitute a valid alternative to the of the existing types of boxing machines/units.

Another advantage of the invention is to provide a boxing unit designed to box a plurality of products inside a box starting from flat blanks which are not pre-glued, which are more economical than pre-glued blanks.

Another advantage of this invention is to provide a machine 1 which is particularly fast, is able operate at particularly high operating speeds, and has a reduced size.

The invention also defines a method for boxing packaged food products (in particular capsules containing extraction and infusion products) comprising the following steps:

preparing a blank (SB) equipped with a plurality of lateral faces (SB2, SB5, SB6, SB7, SB8, SB9, SB10, SB11, SB12, SB13), at least one upper face (SB4, SB5) and a bottom face (SB1);

preparing a rotary element 2 equipped with at least one cavity defining a first receiving seat S1;

preparing a folding mould 14 equipped with a suitable seat 46 for housing the blank SB when opened up;

positioning the flat blank SB at the folding mould 14;

opening up the blank SB by insertion of the blank SB in the housing seat 46 of the folding mould 14;

transferring the blank SB from the mould 14 to a first seat S1 of the rotary element 2;

inserting the packaged food products inside the blank SB with the blank SB retained in the first receiving seat S1;

closing the blank SB to define a box S.

According to the invention, the step of opening up the blank SB comprises a step of preparing a punch 43 for making contact with and pushing the blank SB inside the housing seat of the folding mould 14.

Advantageously, the step of closing the blank SB comprises the step of folding a first and a second upper face (SB4, SB5), and, if necessary, other lateral faces, and gluing the same, so as to close the blank containing the packaged food products and define a box S.

According to another aspect, the method comprises a step of weakening at least one connecting hinge between at least one upper face SB4 and a lateral face SB3 of the blank SB.

According to another aspect, the method further comprises a step of weakening at least one connecting hinge between at least one upper face SB4 and a lateral face SB3 of the blank SB, before or after the step of inserting the packaged food products inside the blank SB with the blank SB retained in the first receiving seat S1.

According to another aspect, the step of weakening at least one connecting hinge between at least one upper face SB4 and a lateral face SB3 of the blank SB comprises a step of making contact using contact elements 20, 21, from opposite surfaces, with the above-mentioned at least one upper face SB4 of the blank SB to which the connecting hinge is associated.

According to another aspect, the step of inserting the packaged food products inside the blank SB comprises inserting the packaged food products according to a direction of insertion which is perpendicular to a longitudinal direction of the box S.

According to another aspect, the method comprises a step of preparing a punch 43 and the step of opening up the blank SB by an insertion of the blank SB in the housing seat 46 of the folding mould 14 comprises a step of making contact, through the punch 43, with the blank SB to push inside the housing seat 46 of the folding mould 14 with consequent folding of the blank SB.

According to another aspect, the step of preparing a folding mould 14 equipped with a suitable seat 46 for housing the blank when opened up comprises a step of preparing a folding mould 14 which has at the housing seat of the blank SB an inlet opening of the blank and an outlet opening 47, and wherein the step of transferring the blank SB from the mould 14 to a first seat S1 of the rotary unit 2 comprises a step of passing the blank SB through the outlet opening 47 of the blank SB.

Described below is a variant embodiment not illustrated.

It should be noted that, according to this second embodiment, each first seat S1 is movable radially relative to the first axis X1 of the first rotary element 2 between a first and a second position.

Preferably, each first seat S1 is connected to an arm, positioned radially on the first rotary element 2.

According to one embodiment, the first seat S1 is movable radially relative to a respective arm.

Alternatively, each arm is moved radially by the first rotary element 2 in a slidable fashion and the first seat S1 is fixed relative to the respective arm.

Preferably, each first seat S1 is movable radially relative to the first axis X1 of the first rotary element 2 between a first position close to the axis of rotation X1 of the first rotary element 2 and a second position away from the axis of rotation X1 of the first rotary element 2.

According to this aspect, preferably, the first seat S1 is positioned in the position far from the axis of rotation X1 of the first rotary element 2 at the angular position where the transfer of the blank from the mould 14 to the first seat S1 is performed. More specifically, according to this aspect, the first seat S1 is moved in such a way that it is positioned in the far position relative to the first axis X1: in this far position the first seat S1 is particularly close to the mould 14 so as to be able to receive the suitably folded blank.

It should be noted that, after transferring the blank from the magazine 4 to the first seat S1, the first seat S1 is moved from the far position to the position close to the first axis of rotation X1.

It should be noted that, according to the embodiment described, the mould 14 may be stationary, that is fixed to the frame, or it may be movable (preferably radially relative to the axis X1 of rotation of the first rotary element 2).

It should be noted that, if the mould 14 is stationary, the first seat S1 is moved to the folding station ST2 from the near position towards the far position, so as to make contact with the blank SB. It should also be noted that, in this case, the folding of the faces to allow the opening up of the blank SB is performed according to the same methods illustrated and described above with reference to the first embodiment.

It should also be noted that, preferably, after the reception of the blank SB coming from the mould 14 by the first seat S1, the first seat S1 is moved from the far position to the close position.

The invention claimed is:

1. A unit for boxing packaged food products, comprising:

a rotary element, rotatable about a first axis of rotation and comprising a first receiving seat for receiving a blank, the rotary element being configured to rotate the first receiving seat in a plurality of angular positions of rotation;

a feeding station for feeding the blank from a magazine of blanks to a folding mold;

a folding station for opening up, at least partly, the blank positioned on the folding mold, the folding station comprising a punch, acting in conjunction with the folding mold for opening up the blank, the punch being movable at least between a first end position for contact with the blank positioned on the folding mold and a second end position for opening up the blank;

a transfer station for transferring the blank opened up by the folding mold to the first receiving seat when the first receiving seat reaches a first predetermined angular position of rotation, the punch transferring the blank from the folding mold into the first receiving seat of the rotary element when moving from the first end position to the second end position, the folding station being spaced apart from the rotary element;

an insertion station for inserting the packaged food products inside the blank folded open and positioned on the first receiving seat, when the first receiving seat reaches a second predetermined angular position of rotation of the first receiving seat different from the first predetermined angular position;

a closing station for closing the blank folded open and positioned on the first receiving seat and containing the packaged food products to define a box, when the first receiving seat reaches a third predetermined angular position of rotation of the first receiving seat different from the second predetermined angular position, wherein the first receiving seat comprises a plurality of projections aligned parallel to the first axis of rotation, each projection extending radially and having a suction cup configured to retain the blank within the first receiving seat.

2. The unit according to claim 1, comprising a first gluing station configured to release a glue for gluing first portions of the blank folded open and positioned on the first receiving seat and containing the packaged food products, when the first receiving seat reaches a fourth predetermined angular position of rotation of the first receiving seat different from the third predetermined angular position.

3. The unit according to claim 1, further comprising a deformation station configured to weaken connecting hinges between a first upper face and a second lateral face and between a second upper face and a first lateral face of the blank.

4. The unit according to claim 3, wherein the deformation station comprises a first and a second contact element, movable between a non-operating position away from, and an operating position close to, the first receiving seat wherein the first and second contact elements make contact with upper faces of the blank to weaken connecting hinges between the upper faces and respective lateral faces.

5. The unit according to claim 1, wherein the feeding station comprises a transfer arm, movable between a picking up position, wherein the transfer arm picks up the blank from the magazine of blanks and a releasing position, wherein the transfer arm releases the blank on the folding mold.

6. The unit according to claim 5, wherein the transfer arm includes a plurality of prongs with a plurality of transfer suction cups, positioned facing towards the magazine of blanks for retaining the blank.

7. The unit according to claim 1, wherein the first receiving seat is movable radially relative to the first axis of rotation of the rotary element, between a first position, closer to the first axis of rotation, and a second position, at a greater distance from the first axis of rotation.

8. The unit according to claim 1, wherein the folding mold is positioned in a predetermined position relative to the first axis of rotation of the rotary element and includes an opening facing towards the rotary element.

9. The unit according to claim 8, wherein the punch and the opening are dimensioned in such a way that the punch passes through the opening, at least partly.

10. The unit according to claim 9, wherein the opening is sized to allow an insertion of a bottom wall of the blank opened up.

11. The unit according to claim 1, wherein the insertion station is configured for inserting the packaged food products inside the blank along a direction of insertion which is perpendicular to a longitudinal direction of the box.

12. The unit according to claim 1, wherein the first receiving seat comprises two opposite retaining elements facing each other at opposite sides along the first axis of rotation.

13. The unit according to claim 1, wherein the projections of the first receiving seat are coupled to a rotary supporting body.

14. The unit according to claim 13, wherein each projection of the first receiving seat comprises an internal channel communication with the corresponding suction cup.

15. The unit according to claim 14, wherein each internal channel of the first receiving seat is in fluid communication with a common hose lying parallel to the first axis of rotation on the rotary supporting body.

16. A method for boxing packaged food products comprising the following steps:

providing a blank including a plurality of lateral faces, an upper face and a bottom face;

providing a rotary element including at least one cavity defining a first receiving seat;

providing a folding mold including a housing seat for housing the blank opened up;

positioning the blank at the folding mold;

opening up the blank by insertion of the blank in the housing seat of the folding mold;

transferring the blank from the folding mold to the first receiving seat of the rotary element;

inserting the packaged food products inside the blank retained in the first receiving seat;

closing the blank to define a box;

providing a punch to come into abutment with and push the blank inside the housing seat of the folding mold during the step of opening up the blank;

wherein the first receiving seat comprises a plurality of projections aligned parallel to the first axis of rotation, each projection extending radially and having a suction cup configured to retain by vacuum the blank within the first receiving seat.

17. The method according to claim 16, further comprising a step of weakening a connecting hinge between the upper face and one of the lateral faces of the blank, before the step of inserting the packaged food products inside the blank retained in the first receiving seat.

18. The method according to claim 17, wherein the step of weakening the connecting hinge between the upper face and the one of the lateral faces of the blank comprises a step of making contact, using contact elements from opposite surfaces, with the upper face of the blank to which the connecting hinge is associated.

19. The method according to claim 16, wherein the step of inserting the packaged food products inside the blank comprises inserting the packaged food products according to a direction of insertion which is perpendicular to a longitudinal direction of the box.

20. The method according to claim 16, wherein the step of providing the folding mold including the housing seat housing the blank opened up comprises a step of providing the folding mold, at the housing seat, with an inlet opening and an outlet opening for the blank, and wherein the step of transferring the blank from the folding mold to the first receiving seat of the rotary unit comprises a step of passing the blank through the outlet opening.

* * * * *